United States Patent [19]

Tachi et al.

[11] Patent Number: 4,798,335

[45] Date of Patent: Jan. 17, 1989

[54] ROTATING SPRAYING TYPE COATING APPARATUS

[75] Inventors: Kazuyuki Tachi; Chikaaki Okuda; Katsunori Yamada; Yoichi Oyama; Shoichi Suzuki, all of Aichi, Japan

[73] Assignee: Kabushiki Kaisha Toyota Chuo Kenkyusho, Aichi, Japan

[21] Appl. No.: 97,651

[22] Filed: Sep. 16, 1987

[30] Foreign Application Priority Data

Sep. 16, 1986 [JP] Japan ..... 61-218914

[51] Int. Cl.[4] ..... B05B 1/28; B05B 3/10

[52] U.S. Cl. ..... 239/296; 239/224; 239/288.5; 239/291; 239/300

[58] Field of Search ..... 239/288.5, 290, 296, 239/298, 300, 223

[56] References Cited

U.S. PATENT DOCUMENTS

| | | | |
|---|---|---|---|
| 3,178,114 | 4/1965 | Point | 239/223 X |
| 4,025,045 | 5/1977 | Kubiak | 239/288.5 |
| 4,337,895 | 7/1982 | Gallen | 239/223 X |
| 4,545,536 | 10/1985 | Avidon . | |
| 4,572,437 | 2/1986 | Huber | 239/296 X |
| 4,601,921 | 7/1986 | Lee | 239/300 X |
| 4,605,168 | 8/1986 | Tachi et al. | 239/223 X |

FOREIGN PATENT DOCUMENTS

| | | | |
|---|---|---|---|
| 0142377 | 5/1985 | European Pat. Off. . | |
| 216173 | 4/1987 | European Pat. Off. | 239/223 |
| 279775 | 3/1970 | Fed. Rep. of Germany . | |
| 3505619 | 8/1986 | Fed. Rep. of Germany | 239/296 |
| 2569580 | 3/1986 | France . | |
| 54-25270 | 2/1979 | Japan . | |
| 57-180460 | 11/1982 | Japan . | |
| 59-127762 | 8/1984 | Japan . | |

OTHER PUBLICATIONS

European Search Report

*Primary Examiner*—Andres Kashnikow
*Assistant Examiner*—Patrick N. Burkhart
*Attorney, Agent, or Firm*—Oblon, Fisher, Spivak, McClelland & Maier

[57] ABSTRACT

A rotating spraying type coating apparatus having a spraying head attached to a rotating shaft of a rotating drive device, a paint supply passage connected to the proximal end of the spraying head, and a paint radiating portion formed at the distal end of the spraying head to thereby spray paint particles from the paint radiating portion. The apparatus is provided with a partition member which is disposed around the outer periphery of the spraying head in opposing relation to the latter, and at least a pair of air outlet ports which are disposed in such a manner that air is jetted out forwardly from the air outlet ports toward the outer peripheral surface of the partition member. Thus, the direction of spray of paint particles from the paint radiating portion is controlled by means of the jetted air, and it is possible to obtain elliptical and dumbbell-shaped spray patterns which cannot be obtained by the conventional rotating spraying type coating apparatuses.

7 Claims, 8 Drawing Sheets

AIR FLOW RATE 0ℓ/min.

AIR FLOW RATE 500ℓ/min.

FIRST AND SECOND AIR FLOW RATES 0ℓ/min.

FIRST AIR FLOW RATE 200ℓ/min.
SECOND AIR FLOW RATE 0ℓ/min.

FIRST AIR FLOW RATE 0ℓ/min.
SECOND AIR FLOW RATE 300ℓ/min.

FIRST AIR FLOW RATE 200ℓ/min.
SECOND AIR FLOW RATE 300ℓ/min.

ROTATING SPRAYING TYPE COATING APPARATUS

BACKGROUND OF THE INVENTION

1. Field of the Invention

The present invention relates to a rotating spraying type coating apparatus which enables various shapes of spray pattern to be obtained.

2. Description of the Related Art

A typical conventional rotating spray type coating apparatus has heretofore been arranged as follows. A spraying head in the shape of a cylinder, a bell or the like is attached to a rotating shaft or a drive device. A paint supply passage is connected to the proximal end of the spraying head, while a paint radiating portion is formed at the distal end of the spraying head, and air outlet ports for jetting out a stream of a air which bends forwardly the particles of paint radiated from the paint radiating portion are provided in the form of a circular ring. In this arrangement, adjustment of spray patterns is effected by varying the rate of flow of the air jetted out from the air outlet port.

The above-described conventional coating apparatus suffers, however, from the following problems. Even if the flow rate of the jetted air is changed greatly (air flow rate: 0 to 500 l/min), the shape of spray pattern remains in the doughnut-shaped configuration, and there is no substantial change in the width of the spray pattern, which means that the range within which the spray pattern can be adjusted is disadvantageously narrow. It is, needless to say, impossible to obtain an elliptical or dumbbell-shaped spray pattern.

There has been another sort of conventional rotating spraying type coating apparatus in which a multiplicity of air outlet ports are provided around the outer periphery of the spraying head so as to control the air jetted out from the outlet ports in the circumferential direction of the spraying head and to thereby control the shape of the spray pattern (see Japanese Utility Model Laid-Open No. 54-25270). In this prior art, the velocity and width of the stream of air which passes the area apart from the outer peripheral surface of the spraying head are controlled in the circumferential direction of the spraying head to thereby control the diffusion of paint particles radiated centrifugally from the spraying head. However, once the paint particles are diffused around the outer periphery of the spraying head by being radiated centrifugally from the spraying head, it is difficult to control the direction of diffusion of these paint particles by the above-described air stream in regard to the following points and such a control method is therefore inefficient and impractical:

(1) Since the paint particles themselves have a relatively large kinetic energy, it is necessary in order to change the direction of flight (diffusion) of the paint particles to form an air stream having a high velocity or a large width.

(2) An exceedingly large amount of air must be jetted out in order to cover the whole of the paint particles which have already been diffused around the outer periphery of the spraying head with an air stream which satisfies the conditions mentioned in (1).

(3) Since the diameter of the air outlet pitch circle is large, the size and weight of the coating apparatus are increased.

(4) Part of paint particles radiated from the spraying head adhere to portions of the apparatus which are in the vicinity of the air outlet ports, thus causing spit (a kind of paint defect). In order to prevent the occurrence of such an unfavorable phenomenon, the air output ports must be disposed more rearwardly of the spraying head, and it is necessary to jet out an increased amount of air in order to control the spray pattern.

For the purpose of obtaining an elliptical spray pattern, one sort of rotating spraying type coating apparatus has been proposed which is provided with a multiplicity of first air outlet ports disposed annularly and a second air outlet ports for jetting out an air stream which is used to distort the stream of air jetted out from the first air outlet ports (see Japanese Patent Laid-Open No. 57-180460 and Japanese Utility Model Laid-Open No. 59-127762). In these coating apparatus, however, a second stream of air is collided with an annularly air stream which is formed forwardly of the outer periphery of the spraying head so as to control the velocity and width of the latter air stream in the circumferential direction of the spraying head, thereby controlling the direction of the diffusion or paint particles radiated centrifugally from the spraying head, and the basic idea for design is deemed to be the same as that of the above-described coating apparatus (Japanese Utility Model Laid-Open No. 54-24270). Accordingly, these apparatuses have the same problems and therefore are impractical.

SUMMARY OF THE INVENTION

In view of the above-described circumstances, it is a primary object of the present invention to provide a rotating spraying type coating apparatus which has an enlarged spray pattern adjustable range, that is, which enables elliptical and dumbbell-shaped spray patterns to be obtained in addition to circular (including doughnut-shaped) spray patterns.

The present inventors made exhaustive studies of various methods of controlling the spray pattern in rotating spraying type coating apparatuses and reached the following conclusion:

(1) In order to control the spray pattern efficiently (with a minimized amount of air), it is essential that paint particles should not be diffused centrifugally from the spraying head. The arrangement in which paint particles are not diffused centrifugally from the spraying head facilitates the control of the spray pattern and, at the same time, eliminates the fear of paint particles adhering to the coating apparatus, which means that no spitting is generated.

(2) In order to prevent paint particles from being diffused centrifugally from the spraying head, it is necessary to form an air stream having a high velocity along the paint radiating portion of the spraying head.

(3) A high-velocity air stream is formed as shown in FIGS. 1 to 3 by a partition member which is provided around the outer periphery of the spraying head in one device or as a separate member and ideally in such a manner that the distal end of the partition member is positioned rearwardly of the paint radiating portion of the spraying head, and by jetting out air forwardly toward the outer peripheral surface of the partition member from at least a pair of air outlet ports which are ideally symmetrically disposed with respect to the axis of the spraying head. More specifically, the air which is jetted out from the air outlet ports strikes on the outer peripheral surface of the partition member and the air then flows along the outer peripheral surfaces of the partition member and the spraying head and collides with the stream of air which is jetted out from the other air outlet port at the substantially intermediate points on the outer peripheral surface of the spraying head between the two air outlet ports, thus forming fanning air streams. The feature of this arrangement resides in high-velocity air streams which flow along the outer peripheral surfaces of the partition member and the spraying head and fan-shaped high-velocity air streams formed by said air streams which collide with each other at the intermediate points on the outer peripheral surface of the spraying head. The former air streams serve to prevent the paint particles radiated centrifugally from the spraying head from being diffused centrifugally and to carry the paint particles to positions near the intermediate points on the outer peripheral surface of the spraying head. The latter air streams serve to fan the paint particles carried near the intermediate points on the outer peripheral surface. Thus, the spray pattern is eventually formed into an elliptical or dumbbell shape.

According to a first aspect of the present invention, there is provided a rotating spraying type coating apparatus having a spraying head attached to a rotating shaft of a rotating drive device, a paint supply passage connected to the proximal end of the spraying head, and a paint radiating portion formed at the distal end of the spraying head to thereby spray paint particles, wherein the improvement comprises at least one partition member disposed around the outer periphery of the spraying head, and at least a pair of air outlet ports disposed in such a manner that air is jetted out forwardly from the air outlet ports toward the outer peripheral surface of the partition member, whereby the direction of spray of paint particles from the paint radiating portion is controlled by means of the jetted air.

According the a second aspect of the present invention, there is provide a rotating spraying type coating apparatus comprising the above-described partition member and air outlet ports (second air outlet ports), and at least one annularly provided air outlet port (first air outlet ports) for jetting out a stream of air which bends forwardly the paint particles sprayed from the paint radiating portion.

In the apparatus according to the first aspect of the present invention having the above-described arrangement, air is jetted out from at least a pair of air outlet ports forwardly toward the outer peripheral surface of the partition member which is disposed around the outer periphery of the spraying head and in opposing relation to the latter, and from this jetted air are formed air streams which flow along the outer peripheral surfaces of the partition member and the spraying head and fan-shaped air stream(s) which are formed from said air streams colliding with each other at the intermediate points of the outer peripheral surface of the spraying head (see FIGS. 1 to 3), thereby making it possible to obtain elliptical and dumbbell-shaped spray patterns which cannot be obtained by the conventional rotating spraying type coating apparatuses, and thus providing the practical advantage that the spray pattern adjustable range is enlarged.

It should be noted that the above-described air streams which flow along the outer peripheral surfaces of the partition member and the spraying head serve to prevent the paint particles sprayed centrifugally from the spraying head from being diffused centrifugally and also to carry the paint particles so that the particles are gathered in the vicinities of the intermediate points on the outer peripheral surface of the spraying head. In addition, the fanning air streams serve to carry the paint particles concentrated on the intermediate points on the outer peripheral surface of the spraying head in such a manner that the particles are sprayed in the shape of a fan.

In the apparatus according to the second aspect of the present invention having the above-described arrangement, an annular or circular air stream is formed by means of air jetted out forwardly from the first air outlet ports. The paint particles which are carried by this air stream form an annular or circular spray pattern. Further, since the apparatus according to the second aspect of the invention has in addition to the above-described first air outlet ports at least a pair of second air outlet ports for jetting out air forwardly toward the outer peripheral surface of the partition member which is disposed around the outlet periphery of the spraying head in opposing relation to the latter, it is possible to set the spray pattern in the shape of a large-diameter doughnut, a small-diameter circle, an ellipse or dumbbell by appropriately varying the rate of flow of air jetted out from each of the air outlet ports. Accordingly, this apparatus has the considerably great practical advantage that the spray pattern adjustable range is wider than that of the coating apparatus having the arrangement according to the first aspect of the present invention.

The above and other objects, features and advantages of the present invention will become more apparent from the following description of the preferred embodiments thereof taken in conjunction with the accompanying drawings.

DESCRIPTION OF THE PREFERRED EMBODIMENTS

The present invention will be described hereinunder in detail with reference to the accompanying drawings.

Figure 1:
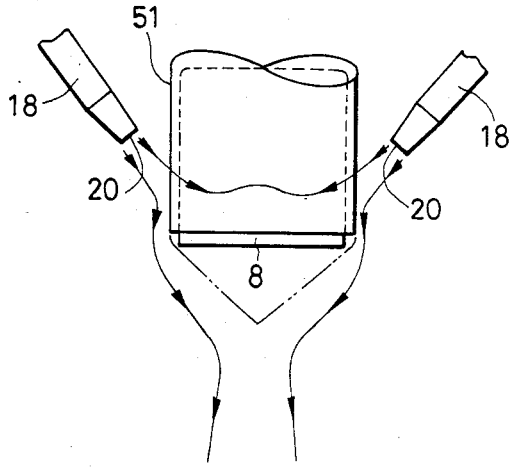
FIGS. 1 to 3 schematically show the way in which air stream flow for the purpose of illustrating the basic concept of the present invention.
Figure 2:
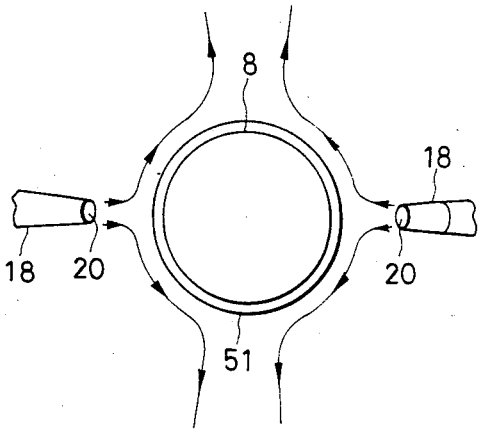
Figure 3:
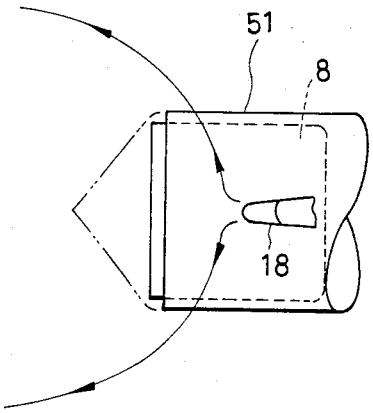
Figure 4:
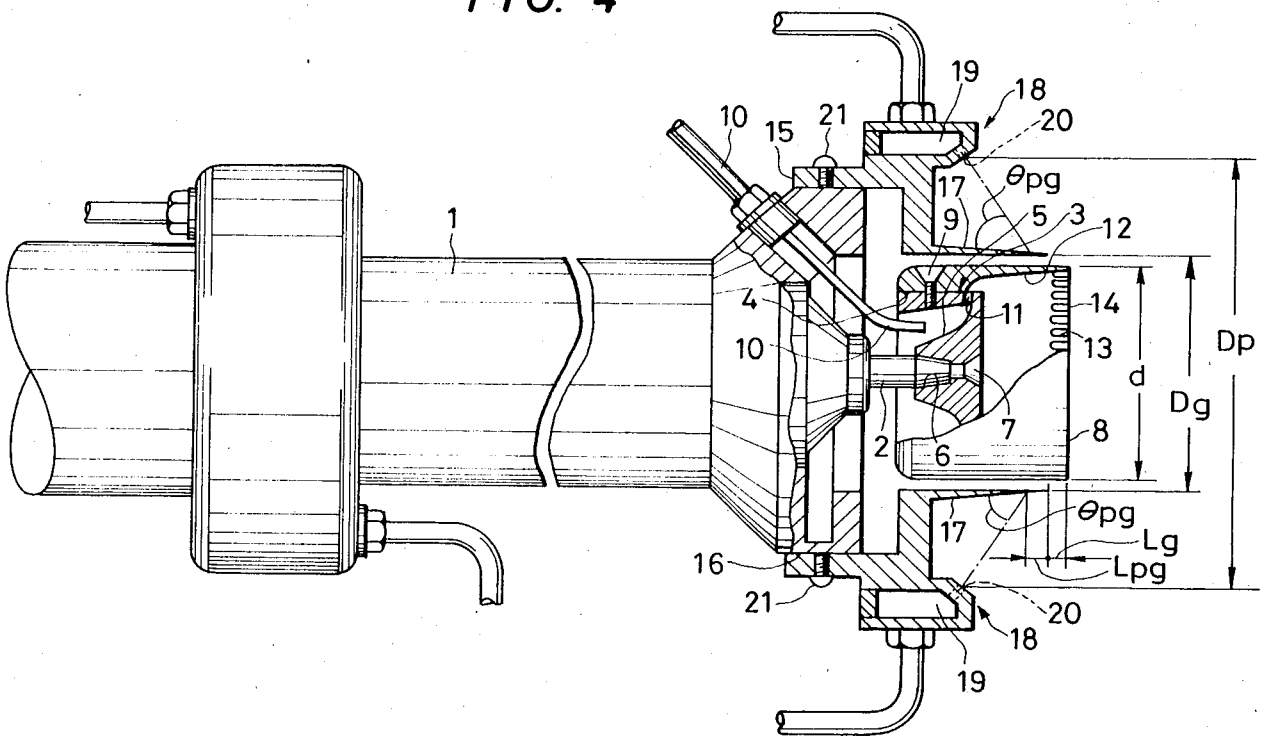
FIGS. 4 and 5 are a partially-sectioned side view and a front view, respectively, of an apparatus according to a first embodiment of the present invention.
Figure 5:
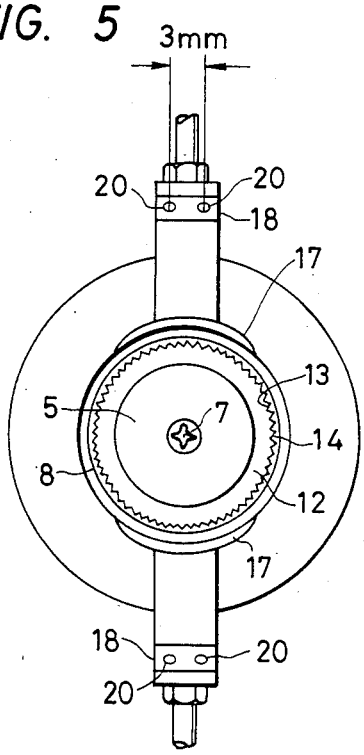

First Embodiment:

Referring first to FIGS. 4 and 5, which show a rotating spraying type coating apparatus according to this embodiment, a rotating shaft 2 projects from the distal end of the casing of an air turbo motor 1 whose maximum rotating is 60,000 r.p.m. A hub 3 is composed of a cylindrical portion 4 and a disk portion 5 concentrically provided at the distal end of the cylindrical portion 4. The hub 3 is fitted on the projecting end portion of the rotating shaft 2, and the tapered distal end portion of the rotating shaft 2 of the air turbo motor 1 is tightly fitted into a tapered mounting bore 6 which is provided in the center of the disk portion 5 of the hub 3. The hub 3 is concentrically mounted on the rotating shaft 2 of the air turbo motor 1 by means of a screw 7 which is screwed through the center of the disk portion 5 of the hub 3. The rear-half portion of a cylindrical member 8 is fitted on the outer periphery of the hub 3 in such a manner that the front-half portion of the cylindrical member 8 projects forwardly of the hub 3, and the cylindrical member 8 is concentrically mounted on the hub 3 by means of screws 9 which are screwed through the peripheral wall of the member 8, thereby connecting together the hub 3 an the cylindrical member 8 in one device, and thus constituting a spraying head 3, 8. The spraying head 3, 8 is connected to a direct-current high-voltage generator (not shown) through the air turbo motor 1 and thus used also as an electrode.

A paint supply passage 10 which is connected to a paint supply device (not shown) is attached to the distal end of the casing of the air turbo motor 1 in such a manner that the opening at the distal end of the paint supply passage 10 is disposed within the cylindrical portion 4 of the hub 3 which constitutes the spraying head 3, 8. In this way, the paint supply passage 10 is connected to the proximal end of the spraying head 3, 8. A multiplicity of paint passing bores 11 are provided at equal intervals in the peripheral wall of the distal end of the cylindrical portion 4 of the hub 3 of the spraying head in such a manner that the bores 11 are communicated with the interior of the front-half portion of the cylindrical member 8, and the inner peripheral surface of the front-half portion of the cylindrical member 8 is designed to define a paint flowing surface 12. In addition, a multiplicity of paint splitting grooves 13 are provided at equal intervals in the inner peripheral surface of the distal end of the cylindrical member 8 in such a manner that the grooves 13 extend axially of the member 8 for the purpose of preventing paint particles from including air. Thus, a paint radiating portion 14 is defined by the edge of the opening at the distal end of the cylindrical member 8.

A pair of partition members 17 having a crescent cross-section are formed integral with a pair of air jet members 18, respectively. The air jet members 18 are secured to the upper and lower end surfaces 15 and 16 of the distal end of the casing of the air turbo motor 1 by means of screws 21 in such a manner that the partition members 17 are disposed around the spraying head 3, 8. Air passages 19 are respectively defined within the pair of air jet members 18 which are disposed around the outer periphery of the spraying head 3, 8, and the air passages 19 are connected to a high-pressure air supply device (not shown) through a flow rate control value (not shown). Two air outlet ports 20 are provided in the front inner peripheral surface of each of the air jet members 18 which is located rearwardly of the paint radiating portion 14 of the spraying head 3, 8 in such a manner that the air outlet ports 20 are communicated with the corresponding air passages 19 and the prolongation of the axis of each of the ports 20 intersects the outer peripheral surface of the partition member 17 and, further, the two pairs of air outlet ports 20 are in symmetry with each other with respect to the axis of the spraying head 3, 8. The two air outlet ports 20 which are provided in each of the air jet members 18 are spaced apart from each other by 3 mm in the circumferential direction of the spraying head 3, 8.

The total number of air outlet ports 20 is four and the diameter thereof is 1.8 mm. The total opening area S of the air outlet ports 20 is preferably set so as to be about 50 $mm^2$ or less from the practical point of view. In this embodiment, the total opening area S is selected so as to be about 10 $mm^2$.

The distal end of each of the crescent partition member 17 is located rearwardly of the paint radiating portion 14 of the spraying head 3, 8. The distance $L_g$ from the distal end of the partition member 17 to the paint radiating portion 14 is selected so as to be 5 mm in this embodiment. The crescent partition members 17 are positioned on a circle with its center at the axis of the spraying head 3, 8. The diameter $D_g$ of this circle must satisfy the condition of $D_p > D_g > d$. The diameter $D_g$ is 41 mm is this embodiment.

The angle $\theta_{pg}$ which is made between the prolongation of the axis of each air outlet port 20 and the outer peripheral surface of the corresponding crescent partition member 17 may be selected so as to fall within the range from 0° to 90°. In this embodiment, the angle $\theta_{pg}$ is selected so as to be 50°. The distance $L_{pg}$ from the intersection between the prolongation of the axis of each air outlet port 20 and the outer peripheral surface of the corresponding partition member 17 to the distal end of said partition member 17 may be selected so as to fall within the range from 0 to 50 mm. In this embodiment, the distance $L_{pg}$ is selected so as to be 10 mm.

It should be noted that the distance $D_p$ between the upper and lower air outlet ports 20 must satisfy the condition of $4d \geqq D_p$ from the practical point of view. In this embodiment, the distance $D_p$ is selected so as to be 50 mm, and the outer diameter of the spraying head 3, 8, that is, the outer diameter d of the paint radiating portion 14, is selected so as to be 37 mm.

As the rotating spraying type coating apparatus in accordance with this embodiment is driven, the spraying head 3, 8 is rotated at high velocity A direct-current high voltage is applied between the spraying head 3, 8 also serving as an electrode and an object to be coated (not shown) which is disposed in front of the spraying head 3, 8. Further, high-pressure air is supplied to the air passages 19, and air is thereby jetted out forwardly from the air outlet ports 20. In addition, paint is supplied from the paint supply passage 10 to the inside of the hub 3 which constitutes the proximal-end side of the spraying head. The paint which is supplied to the inside of the hub 3 of the rotating spraying head is centrifugally passed through the multiplicity of paint passing bores 11 to reach the inside of the front-half portion of the cylindrical member 8. The paint then flows along the paint flowing surface 12 of the cylindrical member 8 in the form of a thin film and flows into the multiplicity of paint splitting grooves 13 where the paint flows in the form of a multiplicity of filament-like streams, and the paint is then sprayed radially from the paint radiating portion 14. Thus, the paint is atomized in the shape of filaments. At this time, the particles of paint sprayed from the paint radiating portion 14 are carried by high-speed air streams which are formed by the air jetted out forwardly from the two (upper and lower) pairs of air outlet ports 20 toward the outer peripheral surfaces of the crescent partition members 17 and which flow along the outer peripheral surfaces of the partition members 17 and the spraying head 3, 8, and the paint particles are thus gathered in the vicinities of the intermediate points on the outer peripheral surface of the spraying head 3, 8. The paint particles are further spread in the shape of a fan by means of fan-shaped air streams which are formed by the above-described high-speed air streams colliding with each other at the intermediate points on the outer peripheral surface of the spraying head 3, 8. The fanned paint particles are caused to fly and adhere to the surface of the object to be coated by means of the force produced by the air streams and by means of the electrostatic attraction acting between the paint particles and the object to be coated.

Figure 6:
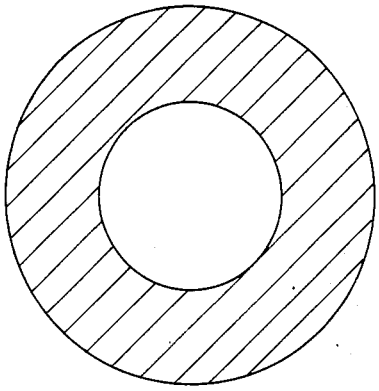
FIGS. 6 and 7 schematically show spray patterns, respectively, obtained by the apparatus according to the first embodiment.
Figure 7:
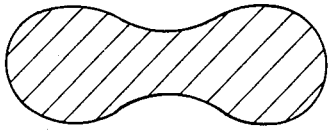
Figure 9:
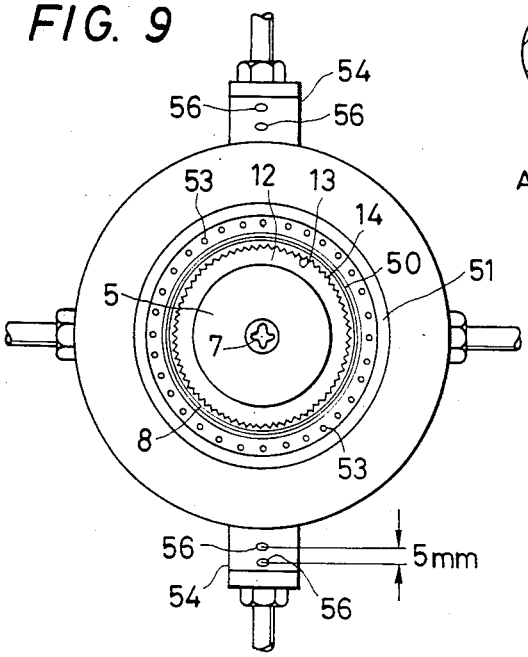
FIGS. 8 and 9 are a partially-sectioned side view and a front view, respectively, of an apparatus according to a second embodiment of the present invention.
Figure 8:
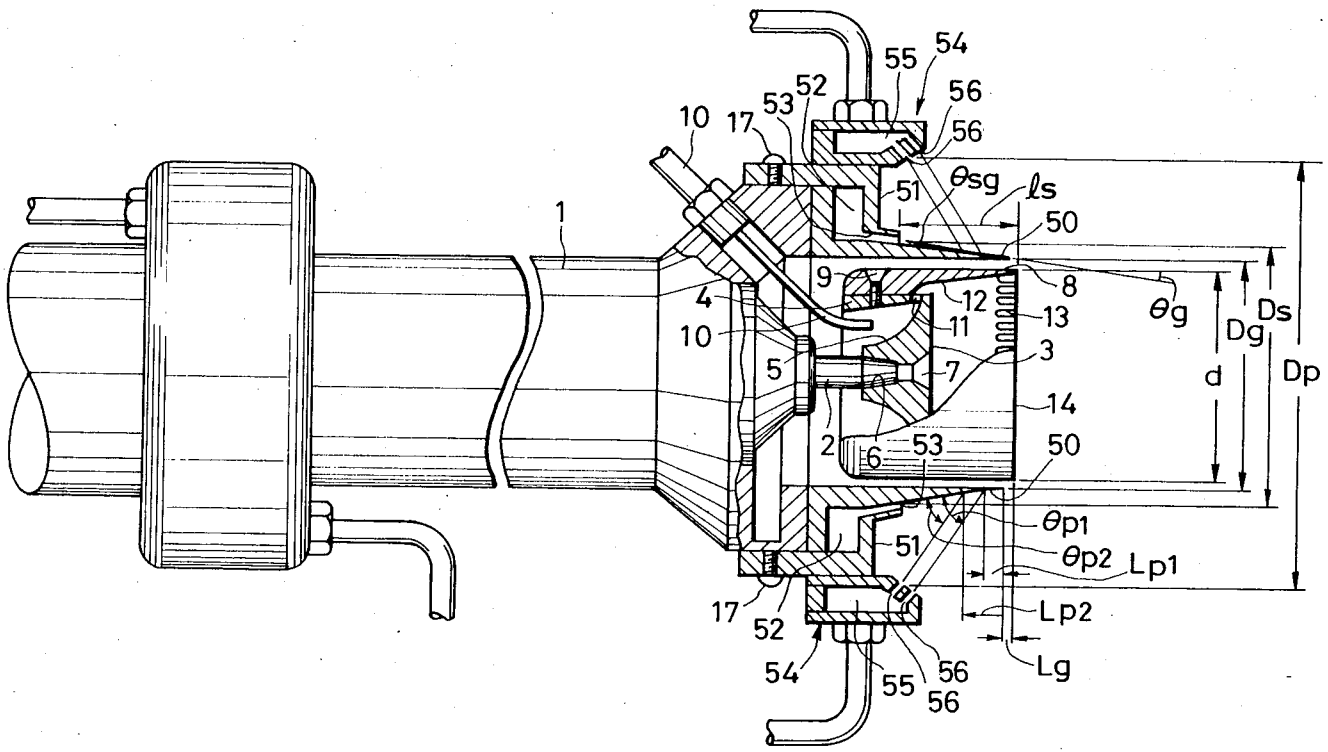
Figure 10:
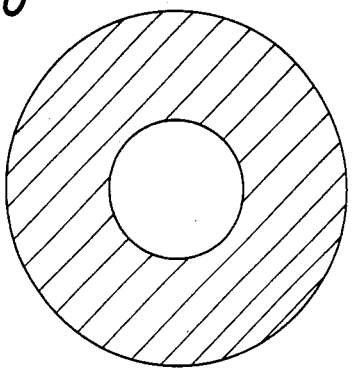
FIGS. 10 to 13 schematically show spray patterns, respectively, obtained by the apparatus according to the second embodiment.
Figure 11:
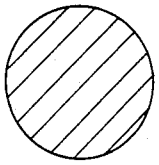
Figure 12:
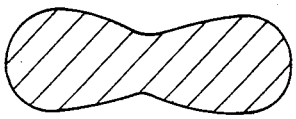
Figure 13:
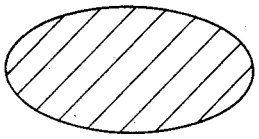

In the case of the rotating spraying type coating apparatus according to this embodiment, the relationship between the air flow rate and the spray pattern is as shown in FIGS. 6 and 7. As illustrated, when the air flow rate is 0, the spray pattern is in the shape of a doughnut having a relatively large diameter, whereas, when air is jetted out at a flow rate of 500 l/min, the spray pattern is in the shape of a dumbbell having a relatively large width. It should be noted that no adhesion of paint particles to the coating apparatus was found at either of the two different air flow rates. Second Embodiment:

Referring to FIGS. 8 and 9, which show a rotating spraying type coating apparatus according to this embodiment, a rotating shaft 2 projects from the distal end of the casing of an air turbo motor 1 whose maximum rotating speed is 60,000 r.p.m. A hub 3 is composed of a cylindrical portion 4 and a disk portion 5 concentrically provided at the distal end of the cylindrical portion 4. The hub 3 is fitted on the projecting end portion of the rotating shaft 2, and the tapered distal end portion of the rotating shaft 2 of the air turbo motor 1 is tightly fitted into a tapered mounting bore 6 which is provided in the center of the disk portion 5 of the hub 3. The hub 3 is concentrically mounted on the rotating shaft 2 of the air turbo motor 1 by means of a screw 7 which is screwed through the center of the disk portion 5 of the hub 3. The rear-half portion of a cylindrical member 8 is fitted on the outer periphery of the hub 3 in such a manner that the front-half portion of the cylindrical member 8 projects forwardly of the hub 3, and the cylindrical member 8 is concentrically mounted on the hub 3 by means of screws 9 which are screwed through the peripheral wall of the member 8, thereby connecting together the hub 3 and the cylindrical member 8 in one device, and thus constituting a spraying head 3, 8. The spraying head 3, 8 is connected to a direct-current high-voltage generator (not shown) through the air turbo motor 1 and thus used alone as an electrode.

A paint supply passage 10 which is connected to a paint supply device (not shown) is attached to the distal end of the casing of the air turbo motor 1 in such a manner that the opening at the distal end of the paint supply passage 10 is disposed within the cylindrical portion 4 of the hub 3 which constitutes the spraying head 3, 8. In this manner, the paint supply passage 10 is connected to the proximal end of the spraying head 3, 8. A multiplicity of paint passing bores 11 are provided at equal intervals in the peripheral wall of the distal end of the cylindrical portion 4 of the hub 3 of the spraying head in such a manner that the bores 11 are communicated with the interior of the front-half portion of the cylindrical member 8, and the inner peripheral surface of the front-half portion of the cylindrical member 8 is designed to define a paint flowing surface 12. In addition, a multiplicity of paint splitting grooves 13 are provided at equal intervals in the inner peripheral surface of the distal end of the cylindrical member 8 in such a manner that the grooves 13 extend axially of the member 8 for the purpose of preventing paint particles from including air. Thus, a paint radiating portion 14 is defined by the edge of the opening at the distal end of the cylindrical member 8.

An annular partition member 50 is formed integral with an annular member 51. The annular member 51 is secured to the distal end of the casing of the air turbo motor 1 in such a manner that the partition member 50 is concentrically disposed around spraying head 3,8. An annular first air passage 52 is defined within the annular member 51 which is disposed around the outer periphery of the annular partition member 50. A high-pressure air supply device (not shown) is connected to the side portion of the first air passage 52 through a flow rate control valve (not shown). A multiplicity of first air outlet ports 53 are provided in the front surface of the annular member 51 which is located rearwardly of the annular partition member 50 in such a manner that the air outlet ports 53 are communicated with the first air passage 52 and are equally spaced apart from each other and disposed at equal distances from the axis of the spraying head 3, 8.

Further, a pair of second air jet members 54 are secured to the upper and lower end portions, respectively, of the annular member 51 by means of screws (not shown). Second air passages 55 are respectively defined within the pair of second air jet members 54 which are disposed around the outer periphery of the annular member 51, and the second air passages 55 are connected to a high-pressure air supply device (not shown) through a flow rate control valve (not shown). Two second air outlet ports 56 are provided in the front inner peripheral surface of each of the pair of second air jet members 54 which is located rearwardly of the paint radiating portion 14 of the spraying head 3, 8 in such a manner that the second air outlet ports 56 are communicated with the corresponding second air passages 55 and the prolongation of the axis of each of the ports 56 intersects the outer peripheral surface of the annular partition member 50 and, further, the two pairs of air outlet ports 56 are in symmetry with each other with respect to the axis of the spraying head 3, 8.

The two second air outlet ports 56 which are bored in each of the second air jet members 54 are spaced apart from each other by 5 mm in the radial direction of the spraying head 3, 8.

The total number of first air outlet ports 53 is 33 and the diameter thereof is 0.6 mm. The total opening area $S_s$ of the first air outlet ports 53 is preferably set so as to be about 50 $mm^2$ or less from the practical point of view. In this embodiment, the total opening area $S_s$ is selected so as to be about 10 $mm^2$. The distance $l_s$ from the opening of each of the first air outlet ports 53 to the paint radiating portion 14 of the spraying head 3, 8 must satisfy the condition of $0<l_s\leqq 50$. In this embodiment, the distance $l_s$ is selected so as to be 20 mm. The angle $\theta_{sg}$ which is made between the prolongation of the axis of each air outlet port 53 and the outer peripheral surface of the annular partition member 50 or the prolongation thereof must satisfy the condition of $0°\leqq\theta_{sg}<90°$ from a practical point of view. In this embodiment, the angle $\theta_{sg}$ is selected so as to be 0°. It should be noted that the center diameter $D_s$ of the first air outlet ports 53 which are disposed in the shape of a circle which is concentrical with respect to the spraying head 3, 8 is set at 47 mm, and the outer diameter of the spraying head 3, 8, that is, the outer diameter d of the paint radiating portion 14, is set at 37 mm.

The distal end of the annular partition member 50 is located rearwardly of the paint radiating portion 14 of the spraying head 3, 8. The distance $L_g$ from the distal end of the partition member 50 to the paint radiating portion 14 must satisfy the condition of $0<L_g\leqq 40$ mm, and it is selected so as to be 1 mm in this embodiment. The distance $L_g$ may be set so as to be larger than 1 mm. However, if the distance $L_g$ is set at an excessively large value, when the air which is jetted out forwardly from the first air outlet ports 53 toward the outer peripheral surface of the partition member 50 flows along the outer peripheral surfaces of the partition member 50 and the spraying head 3, 8, the air is readily accelerated (in the case of the air flowing in the same direction as the direction of rotation) or decelerated (in the case of the air flowing counter to the direction of rotation) by the rotation of the spraying head 3, 8, so that the air stream spread in the shape of a fan is slightly distorted in the direction of rotation of the spraying head 3, 8. As a result, the spray pattern is liable to be slightly distorted in the direction of rotation of the spraying head 3, 8. There is, however, no problem in practical use. The diameter $D_g$ of the distal end of the annular partition member 50 is 35 mm, but it is not necessarily needed to satisfy the condition of $D_s>D_g$. The angle $\theta_g$ which is made between the outer peripheral surface of the annular partition member 50 or the prolongation thereof and the outer peripheral surface of the distal end of the spraying head 3, 8 or the prolongation thereof must satisfy the condition of $0°\leqq\theta g<90°$. In this embodiment, the angle $\theta_g$ is selected so as to be 10°.

The total number of second air outlet ports 56 is four and the diameter thereof is 1.4 mm. The total opening area $S_p$ of the second air outlet ports 56 is about 6 mm$^2$. The angles $\theta_{p1}$ and $\theta_{p2}$ which are made between the prolongations of the axes of the two second air outlet ports 56 (at each end) and the outer peripheral surface of the annular partition member 50 must satisfy the conditions of $90°>\theta_{p1}$ and $\theta_{p2}\geqq 15°$, respectively. In this embodiment, both the angles $\theta_{p1}$ and $\theta_{p2}$ are set at 60°, and the distances $L_{p1}$ and $L_{p2}$ from the intersections between the prolongations of the axes of the two second air outlet ports 56 and the outer peripheral surface of the annular partition member 50 to the distal end of the annular partition member 50 are set at 11 mm and 6 mm, respectively. The distance $D_p$ between the middle point of the two second air outlet ports 56 which are disposed at the upper end portion of the annular member 51 and the middle point of the two second air outlet ports 56 which are disposed at the lower end portion of the annular member 51 is set at 80 mm.

The external appearance of the spraying head 3,8 may have a bell-shaped configuration but it is preferable that its distal end portion should have a smooth outer peripheral surface. The distal end portion of the spraying head 3, 8 may have a claviform or tapering cross-sectional configuration or may be formed so that the diameter is unchanged throughout it. In other words, the angle which is made between the outer peripheral surface of the distal end portion of the spraying head 3, 8 and the axis thereof in a longitudinal sectional view is preferably selected so as to fall within the range from −45° to +45°. In this embodiment, said angle is set at 0°.

As the rotating spraying type coating apparatus in accordance with this embodiment is driven, the spraying head 3, 8 is rotated at high velocity. A direct-current high voltage is applied between the spraying head 3, 8 also serving as an electrode and an object to be coated (not shown) which is disposed in front of the spraying head 3, 8. Further, high-pressure air is supplied to the air passages 52 and 55, and air is thereby jetted out forwardly from the air outlet ports 53 and 56. In addition, paint is supplied from the paint supply passage 10 to the inside of the hub 3 which constitutes the proximal-end side of the spraying head. The paint which is supplied to the inside of the hub 3 of the rotating spraying head is centrifugally passed through the multiplicity of paint passing bores 11 to reach the inside of the front-half portion of the cylindrical member 8. The paint then flows along the paint flowing surface 12 of the cylindrical member 8 in the form of a thin film and flows into the multiplicity of paint splitting grooves 13 where the paint flows in the form of a multiplicity of filamentlike streams, and the paint is then sprayed radially from the paint radiating portion 14. Thus, the paint is atomized in the shape of filaments. At this time, the particles of paint sprayed from the paint radiating portion 14 are caused to fly and adhere to the surface of the object to be coated by means of the force produced by high-speed streams of air which is jetted out forwardly from the first and second air outlet ports 53 and 56 so as to pass through the area around the outer periphery of the paint radiating portion 14 and by means of the electrostatic attraction acting between the paint particles and the object to be coated.

Since the function and effect of the air which is jetted out from the second air outlet ports 56 are substantially the same as those in the case of the first embodiment, description thereof is omitted. The high-speed streams of air which is jetted out forwardly from the first air outlet ports 53 so as to pass through the area around the outer periphery of the paint radiating portion 14 function to concentrate the particles of paint sprayed from the paint radiating portion 14 on the prolongation of the axis of the spraying head 3, 8.

In the case of the rotating spraying type coating apparatus according to this embodiment, the relationship between the air flow rates of the air jetted out from the first air outlet ports 53 (hereinafter referred to as "first air") and the air jetted out from the second air outlet ports 56 (hereinafter referred to as "second air") on the one hand and the spray pattern on the other is such as that shown in FIGS. 10 to 13. As illustrated, when no first nor second air is jetted out, the spray pattern is in the shape of a doughnut having a relatively large diameter, whereas, when the first air alone is jetted out at a flow rate of 200 l/min, the spray pattern is in the shape of a disk having a relatively small diameter. When the second air alone is jetted out at a flow rate of 300 l/min, the spray pattern is in the shape of a dumbbell having a relatively large width, whereas, when the first air and the second air are jetted out at flow rates of 200 l/min and 300 l/min, respectively, the spray pattern is in the shape of an ellipse having a relatively large width.

As described above, the rotating spraying type coating apparatus according to this embodiment advantageously enables the spray pattern to be varied to a substantial extent by controlling the respective flow rates of the first and second air. In general, as the flow rate of the first air is increased, the spray pattern becomes close to the shape of a disk having a relatively small width, whereas, as the flow rate of the second air is increased, the spray pattern becomes close to the shape of an ellipse or dumbbell having a relatively large width.

The total opening areas $S_s$ and $S_p$ of the first and second air outlet ports 53 and 56 are preferably set so that the average velocity of air at the openings of the outlet ports [=air flow rate/total opening area ($S_s$ or $S_p$)] exceeds the speed of sound. Further, the flow rate $Q_1$ of the first air is preferably set so that $Q_1/d$ is 2.5 (l/mm min) or more.

When two or more pairs of second air outlet ports are provided, it is only necessary to dispose at least one pair of second air outlet ports in such a manner that the prolongation of the axis of each of the ports intersects the outer peripheral surface of the annular partition member 50. In addition, the second air outlet ports are not necessarily needed to have the same value for $\theta_{pi}$ (i=1, 2, ...).

Further, it is not always necessary to dispose the second air outlet ports 56 which are at the upper and lower end portions of the annular member 51 in such a manner that they are in symmetry with each other with respect to the axis of the spraying head 3, 8. The prolongations of the axes of these second air outlet ports 56 are not necessarily needed to be in symmetry with each other with respect to the prolongation of the axis of the spraying head 3, 8 either.

Although this embodiment is arranged such that the first air and the second air can be supplied separately from each other, they may be supplied simultaneously. Further, the arrangement may be such that all the air outlet ports are disposed in the shape of a ring and some of them satisfy the condition that the prolongation of the axes of at least one pair of air outlet ports which are positioned around the outer periphery of the spraying head 3, 8 intersect the outer peripheral surface of the annular partition member.

Figure 14:
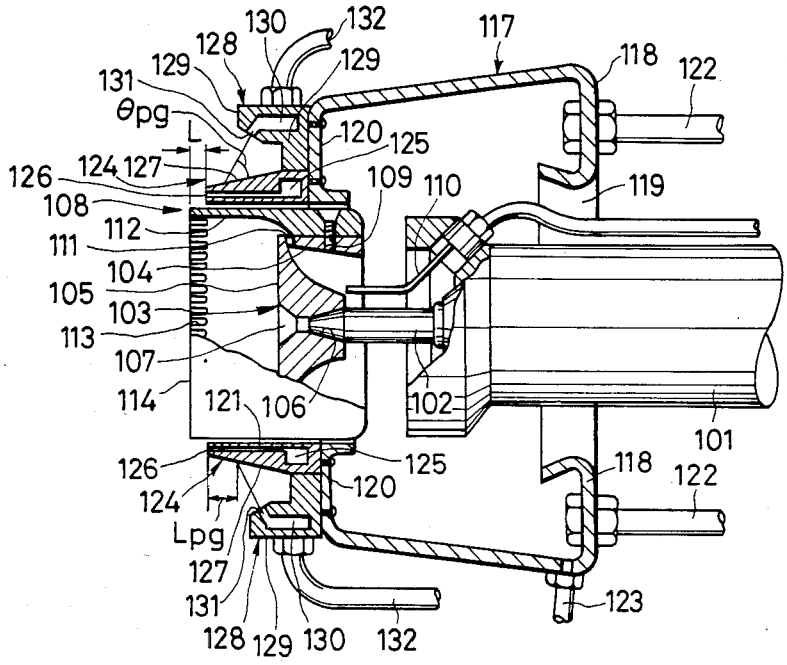
FIGS. 14 and 15 are a partially-sectioned side view and a front view, respectively, of an apparatus according to a third embodiment of the present invention.
Figure 15:
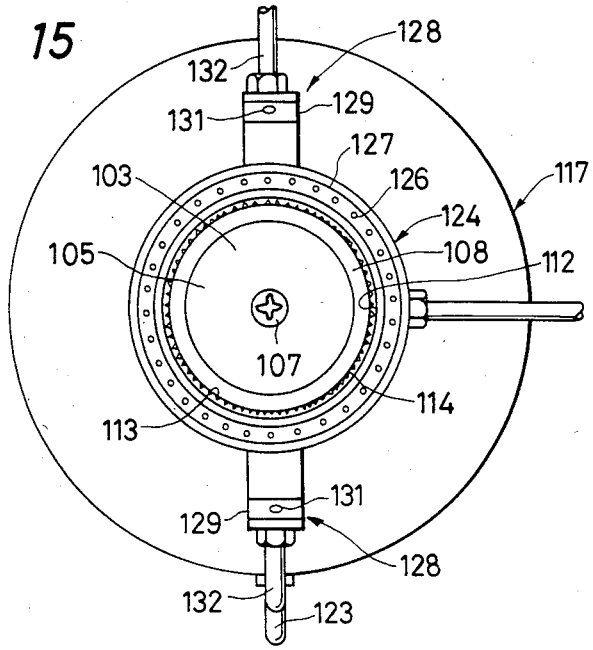

The first air outlet ports may be formed in the shape of slits and disposed annularly. Third Embodiment:

Referring to FIGS. 14 and 15, which show a rotating spraying type coating apparatus with a wash shroud according to this embodiment, a frusto-conical wash shroud 117 made of an insulating material is concentrically disposed around the outer periphery of the spraying head 103, 108 and around the outer periphery of the distal end portion of the air turbo motor 101. The distal ends of driving shafts 122 of a reciprocating drive device (not shown) are connected to a ring-shaped end plate 118 provided at the proximal end of the wash shroud 117, the shafts 122 being made of an insulating material, so that the shroud 117 is movable longitudinally. A washing agent suction passage 123 is connected to the lower portion of the peripheral wall at the proximal end of the wash shroud 117.

A first air jet device 124 is provided at the front side of a ring-shaped end plate 120 provided at the distal end of the wash shroud 117. The first air device 124 has an annular first air passage 125 which is defined so as to be concentrical with respect to the spraying head 103, 108, and a frusto-conical partition member 127 which is formed in front of the first air passage 125 so as to be concentrical with respect to the spraying head 103, 108. A high-pressure air supply device (not shown) is connected to the side portion of the first air passage 125 through a flow rate control valve (not shown). A multiplicity of first air outlet ports 126 are bored in the front surface of the partition member 127 at equal intervals, the ports 126 being communicated with the first air passage 125.

A second air jet device 128 is provided around the outer periphery of the first air jet device 124. The second air jet device 128 has structural blocks 129 disposed at the upper and lower ends, respectively, of the first air jet device 124. Second air passages 130 are defined within the blocks 129, respectively, and high-pressure air supply passages 132 are respectively connected to the outer side portions of the second air passages 130 through flow rate control valves (not shown). A second air outlet port 131 having a diameter of 2.6 mm is provided in the inner front portion of each of the blocks 129 so as to be communicated with the corresponding second air passage 130. Thus, a pair of second air outlet ports 131 are opened in such a manner that the prolongation of the axis of each port 131 intersects the outer peripheral surface of the frusto-conical partition member 127.

It should be noted that a front end opening 121 of the wash shroud 117 is defined by the inner peripheral surface of the annular first air jet device 124 and the inner peripheral surface of the ring-shaped end plate 120 at the distal end of the wash shroud 117, and the diameter of this opening 121 is slightly larger than the outer diameter of the spraying head 103, 108, and the diameter of an opening 119 provided at the proximal end of the wash shroud 117 is larger than the diameter of the opening 121 at the front end of the shroud 117.

When coating is to be conducted using the apparatus according to this embodiment, the reciprocating drive device (not shown) is first driven so as to move the wash shroud 117 backward to the position where the paint radiating portion 114 of the spraying head 103, 108 projects from the opening 121 at the front end of the shroud 117 as shown in FIG. 14.

It should be noted that the distance L from the opening surface of each of the first air outlet ports 126 of the first air jet device 124 to the paint radiating portion 114 of the spraying head 103, 108 must satisfy the condition of $L>0$, and the distance L is selected so as to be 5 mm in this embodiment.

The angle $\theta_{pg}$ which is made between the prolongation of the axis of each of the second air outlet ports 131 of the second air jet device 128 and the outer peripheral surface of the partition member 127 is set at 70°, and the angle which is made between the outer peripheral surface of the partition member 127 or the prolongation thereof and the outer peripheral surface of the distal end of the spraying head 103, 108 or the prolongation thereof is set at 10°.

Next, the spraying head 103, 108 is rotated at high velocity, and a direct-current high voltage is applied between the spraying head 103, 108 also serving as an electrode and an object to be coated (not shown) which is disposed in front of the spraying head 103, 108. Further, high-pressure air is supplied to the air passages 125 and 130 of the first and second air jet devices, and air is thereby jetted out forwardly from the air outlet ports 126 and 131. In addition, paint is supplied from the paint supply passage 110 to the inside of the hub 103.

The paint which is supplied to the inside of the hub 103 of the rotating spraying head is centrifugally passed through the multiplicity of paint passing bores 111 to reach the inside of the front-half portion of the cylindrical member 108. The paint then flows along the paint flowing surface 112 of the cylindrical member 108 in the form of a thin film and flows into the multiplicity of paint splitting grooves 113 where the paint flows in the form of a multiplicity of filamentlike streams, and the paint is then sprayed radially from the paint radiating portion 114. Thus, the paint is atomized in the shape of filaments. At this time, the particles of paint sprayed from the paint radiating portion 114 are caused to fly and adhere to the surface of the object to be coated by means of the force produced by high-speed streams of air which is jetted out forwardly from the first and second air outlet ports 126 and 131 so as to pass through the area around the outer periphery of the paint radiating portion 114 and by means of the electrostatic attraction acting between the paint particles and the object to be coated.

Since the function and effect of the air which is jetted out from the first and second air outlet ports are substantially the same as those in the case of the second embodiment, description thereof is omitted.

In the case of the rotating spraying type coating apparatus according to this embodiment, the relationship between the flow rates of the air jetted out from the first air outlet ports 126 (hereinafter referred to as "first air") and the air jetted out from the second air outlet ports 131 (hereinafter referred to as "second air") on the one hand and the spray pattern on the other is such as that shown in FIGS. 10 to 13.

It should be noted that no adhesion of paint particles to the outer peripheral surface of the spraying head 103, 108, the first and second air jet devices 124, 128 and the wash shroud 117 was found at any air flow rate.

As the distance L from the opening of each of the first air outlet ports 126 to the paint radiating portion 114 is reduced, the velocity of the air stream which passes through the area around the outer periphery of the paint radiating portion 114 increases, but it becomes easier for the paint particles to adhere to the outer peripheral surface of the spraying head 103, 108, the first and second air jet devices 124, 128 and the distal end portion of the wash shroud 117. Accordingly, said distance L is preferably selected so as to fall within the range form 1 to 60 mm, more preferably within the range from 3 to 20 mm.

Figure 16:
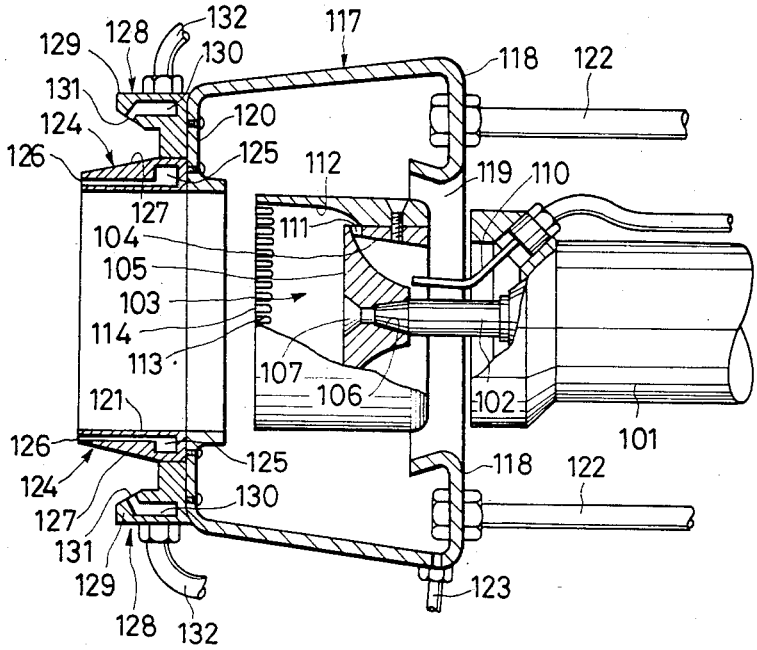
FIG. 16 is a partially-sectioned side view of the apparatus according to the third embodiment with the spraying head is (being) washed.

When washing is to be conducted by driving the coating apparatus according to this embodiment, the reciprocating drive device (not shown) is driven so as to advance the wash shroud 117 to the position where the spraying head 103, 108 is disposed within the shroud 117 as shown in FIG. 16. Thereafter, a solvent for washing or air for drying, that is, a washing agent, is injected through the paint supply passage 110 into the hub 103 of the rotating spraying head which has no direct-current high voltage applied thereto.

The solvent which is injected into the hub 103 of the rotating spraying head is centrifugally passed through the paint passing bores 111, the paint flowing surface 112 and the paint splitting grooves 113, and sprayed from the paint radiating portion 114 in the same way as in the case of the paint during the coating operation, and while doing so, the solvent washes the inner surface of the spraying head 103, 108. The solvent which is sprayed from the paint radiating portion 114 collides against the inner peripheral surface of the wash shroud 117 and is then gathered in the lower portion at the proximal end side of the wash shroud 117 and radiated through the washing agent suction passage 123.

In the coating apparatus according to this embodiment, the first and second air jet devices 124 and 128 are provided at the front end of the wash shroud 117. Therefore, when the wash shroud 117 is advanced for washing the spraying head 103, 108, the air jet devices 124 and 128 are disposed forwardly of the spraying head 103, 108 as shown in FIG. 16. Accordingly, there is no fear of the first and second air jet devices 124, 128 interfering with the washing of the spraying head 103, 108.

The second air outlet ports may be formed in the shape of slits.

Modifications

In the case of the rotating spraying type coating apparatus according to the second embodiment, if the flow rates of the first and second air are switched from one to another by respective high-speed air flow rate controllers, the spray patterns are instantaneously changed from one to another. Such a modification is therefore useful as a coating apparatus for an automatic coating system or a coating robot. If the switching of air flow rates and the switching of paint flow rates are interlocked with each other, the practicability is further improved.

In the present invention, the configuration of the spraying head and the configuration, number and disposition of the air outlet ports are not necessarily limited to those mentioned in the above-described embodiments. For example, although in the described embodiments the pairs of air outlet ports are disposed at positions which face each other across the spraying head, they may be positioned so as to face each other across the air turbo motor. The spraying head of the present invention is not necessarily limited to the cylindrical one with the multiplicity of paint splitting grooves.

Figure 17:
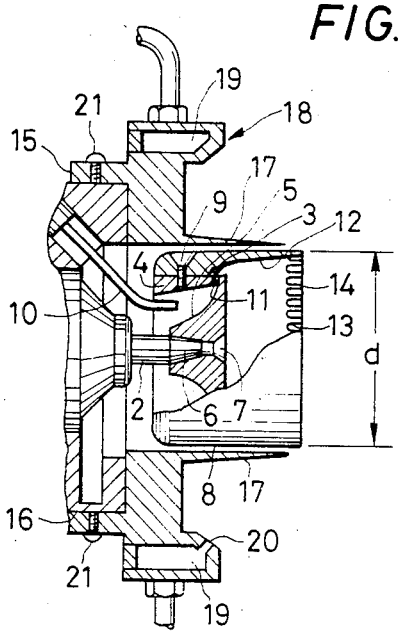
FIGS. 17 to 20 are partially-sectioned side views and front views, respectively, of other embodiments of the present invention.
Figure 18:
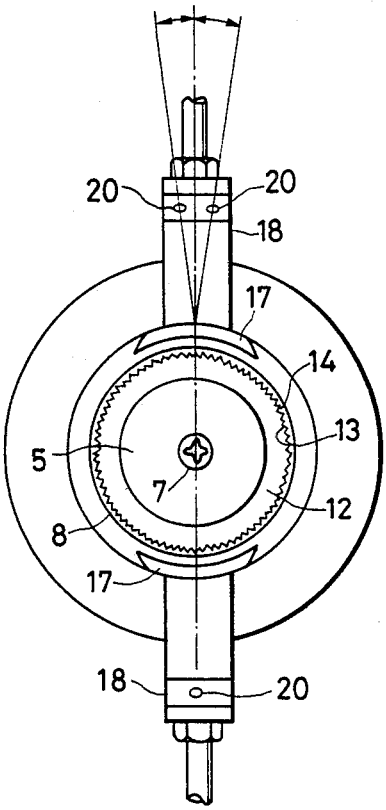

In the rotating spraying type coating apparatus according to the first embodiment, the air outlet ports 20 may be disposed as shown in FIGS. 17 and 18. More specifically, a pair of partition members 17 having a crescent cross-section are formed integral with a pair of air jet members 18, respectively. The air jet members 18 are secured to the upper and lower end surfaces 15 and 16 of the distal end of the casing of the air turbo motor 1 by means of screws 21 in such a manner that the partition members 17 are disposed around the spraying head 3, 8. Air passages 19 are respectively defined within the pair of air jet members 18 which are disposed around the outer periphery of the spraying head 3, 8, and the air passages 19 are connected to a high-pressure air supply device (not shown) through a flow rate control valve (not shown). Two air outlet ports 20 and one air outlet port 20 are respectively provided in the front inner peripheral surfaces of the air jet members 18 which are located rearwardly of the paint radiating portion 14 of the spraying head 3, 8 in such a manner that the air outlet ports 20 are communicated with the corresponding air passages 19 and the prolongation of the axis of each of the ports 20 intersects the outer peripheral surface of the corresponding partition members 17 and, further, the two air outlet ports 20 and the one air outlet port 20 are substantially symmetrical with each other with respect to the axis of the spraying head 3, 8. The two air outlet ports 20 which are provided in the art jet member 18 disposed at the upper and surface 15 are spaced apart from each other by 3 mm in the circumferential direction of the spraying head 3, 8 and are disposed in such a manner that the prolongations of the axes of the air outlet ports 20 intersect each other at the point on the line where the plane which includes the axis of the one air outlet port 20 provided in the air jet member 18 disposed at the lower end surface 16 and the axis of the spraying head 3, 8 intersects the outer peripheral surface of the upper crescent partition member 17.

Further, the total opening area of the two air outlet ports 20 which are provided in the air jet member 18 disposed at the upper end surface 15 is about 5.1 $mm^2$ and the opening area of the one air outlet port 20 provided in the air jet member 18 disposed at the lower end surface 16 is about 4.5 $mm^2$, that is, these opening areas are substantially equal to each other. The rotating spraying type coating apparatus arranged as described above also makes it possible to obtain spray patterns which are substantially similar to those in the case of coating apparatus according to the first embodiment. In the rotating spraying type coating apparatus according to this modification, the air outlet ports are, strictly speaking, not paired, but they are substantially the same as those which are paired in regard to the function. The present invention does not exclude arrangements in which the air outlet ports are regarded as paired from the functional point of view as in the case of the above.

Figure 19:
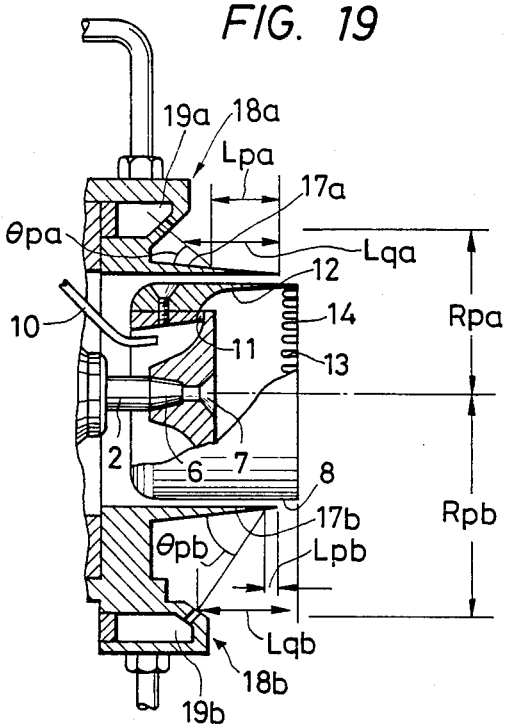
Figure 20:
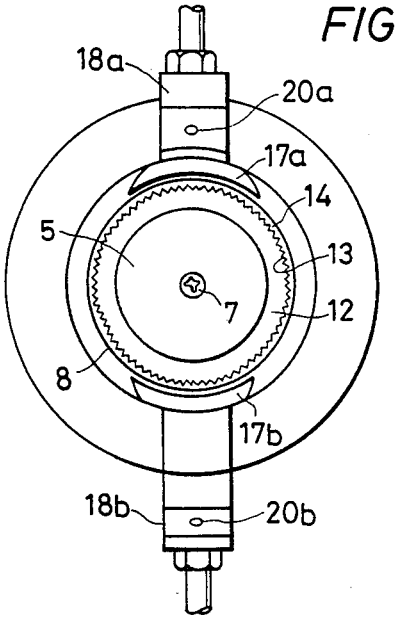

Further, in the rotating spraying type coating apparatus according to the first embodiment, the air outlet ports 20 may be disposed in asymmetry with each other as shown in FIGS. 19 and 20. More specifically, a pair of partition members 17*a* and 17*b* having a crescent cross-section are formed integral with a pair of upper and lower air jet members 18*a* and 18*b*, respectively. The air jet members 18*a* and 18*b* are secured to the upper and lower end surfaces 15 and 16 of the distal end of the casing of the air turbo motor 1 by means of screws 21 in such a manner that the partition members 17*a* and 17*b* are disposed around the spraying head 3, 8. Air passages 19*a* and 19*b* are respectively defined within the pair of air jet members 18*a* and 18*b* which are disposed around the outer periphery of the spraying head 3, 8, and the air passages 19*a* and 19*b* are connected to a high-pressure air supply device (not shown) through a flow rate control valve (not shown). Two air outlet ports 20*a* and 20*b* are respectively provided in the front inner peripheral surfaces of the two air jet members 18*a* and 18*b* which are located rearwardly of the paint radiating portion 14 of the spraying head in such a manner that the air outlet ports 20*a* and 20*b* are communicated with the corresponding air passages 19*a* and 19*b*, and the prolongation of the axis of each of the ports 20*a* and 20*b* intersects the outer peripheral surface of the corresponding partition members 17*a*, 17*b* and, further, the two air outlet ports 20*a* and 20*b* are in asymmetry with each other across the spraying head 3, 8. More specifically, the angle $\theta_{pa}$ is made between the prolongation of the axis of the upper air outlet port 20*a* and the outer peripheral surface of the upper crescent partition member 17*a* is not equal to the angle $\theta_{pb}$ which is made between the prolongation of the axis of the lower air outlet port 20*b* and the outer peripheral surface of the lower crescent partition member 17*b*. Further, the following relations hold between the distances $L_{pa}$ and $L_{pb}$ from the points where the prolongations of the axes of the upper and lower air outlet ports 20*a* and 20*b* intersect the outer peripheral surfaces of the corresponding crescent partition members 17*a* and 17*b* to the distal ends of the partition members 17*a* and 17*b*, the distances $L_{qa}$ and $L_{qb}$ from the openings of the air outlet ports 20*a* and 20*b* to the paint radiating portion 14 of the spraying head 3, 8, and the distances $R_{pa}$ and $R_{pb}$ from the openings of the air outlet ports 20*a* and 20*b* to the axis of the spraying head 3, 8, respectively:

$$L_{pa} \neq L_{pb}$$

$$L_{qa} \neq L_{qb}$$

$$R_{pa} \neq R_{pb}$$

In the rotating spraying type coating apparatus according to this modification, the dumbbell-shaped spray pattern may be distorted, but if each of the values is appropriately set, there is substantially no problem in practical use.

Although in the above-described embodiments the partition members are provided fixedly and separately from the spraying head, the partition members may be provided integral with the spraying head. However, in this case, when the air which is jetted out forwardly from at least a pair of air outlet ports toward the outer peripheral surfaces of the partition members flows along the outer peripheral surfaces of the partition members and the spraying head, the air is readily accelerated (in the case of the air flowing in the same direction as the direction of rotation) or decelerated (in the case of the air flowing counter to the direction of rotation) by the rotation of the spraying head, so that the air stream spread in the shape of a fan is slightly distorted in the direction of rotation of the spraying head. As a result, the spray pattern is liable to be slightly distorted in the direction of rotation of the spraying head. There is, however, no problem in practical use.

In this present invention, the configuration and number of the partition members are not necessarily limited to those mentioned in the above-described embodiments.

The present invention is not necessarily limited to electrostatic coating apparatuses.

Although the transfer efficiency of the present invention is slightly lower than in the case of the conventional rotating spraying type coating apparatuses, it is higher than that in the case of air spray gun or electrostatic air spray gun.

Although the present invention has been described through specific terms, it should be noted here that the described embodiments are not necessarily exclusive and various changes and modifications may be imparted thereto without departing from the scope of the invention which is limited solely by the appended claims.

What is claimed is:

1. A rotating spraying type coating apparatus, comprising:

a rotating drive device having a rotating shaft, a spraying head attached to the rotating shaft of said rotating drive device, said spraying head having a proximal end on the side of said rotating shaft and a distal end on the side of an article to be coated, a paint supply passage connected to said spraying head, a paint radiating portion for radiating paint particles formed at the distal end of said spraying head, at least one partition member disposed outside said spraying head, and air jetting means comprising at least one pair of air outlet ports spaced from and provided outside said at least one partition member, prolongations of central axes of said at least one pair of air outlet ports intersecting an outer peripheral surface of said at least one partition member at a predetermined angle, for jetting air towards the outer peripheral surface of said at least one partition member and for forming air streams spreading in the circumferential direction along the outer peripheral surfaces of said at least one partition member and said spraying head, wherein said air streams from each of said at least one pair of air outlet ports collide with each other at substantially intermediate points on the outer peripheral surface of the spraying head, said air streams having a circumferential velocity component in addition to an axial velocity component such that paint particles radiated centrifugally from said spraying head are prevented from being diffused centrifugally and the spray pattern of said paint from said spraying head is of an eliptical or dumbbell shape.

2. A coating apparatus as claimed in claim 1, wherein said at least one pair of air outlet ports are located substantially symmetrical with respect to the central axis of said spraying head.

3. A coating apparatus as claimed in claim 1, further comprising at least one annularly provided air outlet port for jetting air forwardly, provided outside said spraying head so as to bend forwardly paint particles radiated from said paint radiating portion.

4. A coating apparatus as claimed in claim 1, wherein said at least one partition member is a pair of partition members provided outside said spraying head.

5. A coating apparatus as claimed in claim 1, wherein said at least one partition member is an annular partition member provided around the outer periphery of said spraying head.

6. A coating apparatus as claimed in claim 1, further comprising a wash shroud for collecting washing agent radiated from said paint radiating portion of said spraying head arranged around said spraying head in such a manner that said wash shroud is movable forwardly and backwardly so that said wash shroud is set at a backward position at the time of coating where said paint radiating portion of said spraying head is protruded from a front end opening of said wash shroud and at a forward position at the time of washing where said paint radiating portion of said spraying head is disposed within said wash shroud, wherein said at least one pair of air outlet ports and said at least one partition member are provided around said front end opening of said wash shroud.

7. A coating apparatus as claimed in claim 6, further comprising at least one annularly provided air outlet port for jetting air forwardly, provided around said front end opening of said wash shroud so as to bend forwardly paint particles radiated from said paint radiating portion.

* * * * *